US008151701B2

(12) United States Patent
Horigane et al.

(10) Patent No.: US 8,151,701 B2
(45) Date of Patent: Apr. 10, 2012

(54) APPARATUS AND PROCESS FOR PRODUCING SURFACE-TREATED GRANULAR PRODUCT AND SURFACE-TREATED GRANULAR PRODUCT

(75) Inventors: Akira Horigane, Ushiku (JP); Masaaki Horiguchi, Ushiku (JP)

(73) Assignee: Tsukuba Food Science, Inc., Ibaraki (JP)

( * ) Notice: Subject to any disclaimer, the term of this patent is extended or adjusted under 35 U.S.C. 154(b) by 878 days.

(21) Appl. No.: 12/223,798

(22) PCT Filed: Mar. 30, 2006

(86) PCT No.: PCT/JP2006/306683

§ 371 (c)(1),
(2), (4) Date: Aug. 6, 2008

(87) PCT Pub. No.: WO2007/094085

PCT Pub. Date: Aug. 23, 2007

(65) Prior Publication Data

US 2010/0178852 A1 Jul. 15, 2010

(30) Foreign Application Priority Data

Feb. 11, 2006 (JP) ..... 2006-034604

(51) Int. Cl.
*B02B 1/06* (2006.01)

(52) U.S. Cl. ..... 99/519

(58) Field of Classification Search ..... 99/516–531
See application file for complete search history.

(56) References Cited

U.S. PATENT DOCUMENTS

| | | | | | |
|---|---|---|---|---|---|
| 111,323 | A | * | 1/1871 | Crawford | 99/522 |
| 232,303 | A | * | 9/1880 | Russell | 99/521 |
| 348,890 | A | * | 9/1886 | Crawford | 99/521 |
| 1,774,717 | A | * | 9/1930 | Lorenzen | 99/518 |
| 2,011,110 | A | * | 8/1935 | Lorenzen | 99/518 |
| 4,323,006 | A | * | 4/1982 | Satake | 99/519 |
| 4,829,893 | A | * | 5/1989 | Satake | 99/603 |
| 5,036,757 | A | * | 8/1991 | Mueller | 99/519 |
| 5,076,157 | A | * | 12/1991 | Satake | 99/519 |

(Continued)

FOREIGN PATENT DOCUMENTS

EP 0 424 004 A1 10/1990

(Continued)

OTHER PUBLICATIONS

European Search Report dated Oct. 21, 2011.

(Continued)

*Primary Examiner* — Mark Graham
(74) *Attorney, Agent, or Firm* — Flynn, Thiel, Boutell & Tanis, P.C.

(57) ABSTRACT

A feedstock granular substance (7) is fed into a cylindrical retention tube (3) provided with a multiplicity of retention parts (8) for retaining a granular substance (7) moving along the inner circumference thereof. In the state of having the feedstock granular substance (7) retained by the retention parts (8) of the retention tube (3), a grinding device (4) having multiple flexible long grinding materials (6) radially extending from the rotational axis extending along the axial center of the retention tube (3) is rotated to thereby realize rotation with the distal ends of the long grinding materials (6) brought into contact with the surface of the granular substance (7) and surface treats the granular substance (7). Thus, production of a surface-treated granular substance is attained.

9 Claims, 8 Drawing Sheets

U.S. PATENT DOCUMENTS

| | | | | |
|---|---|---|---|---|
| 5,361,689 | A * | 11/1994 | Lima et al. | 99/575 |
| 5,394,792 | A * | 3/1995 | Satake et al. | 99/519 |
| 5,419,252 | A * | 5/1995 | Satake | 99/519 |
| 5,511,469 | A * | 4/1996 | Satake et al. | 99/519 |
| 7,690,295 | B2 * | 4/2010 | Ishizuka | 99/519 |
| 2002/0104447 | A1 * | 8/2002 | Munesada et al. | 99/519 |
| 2003/0121844 | A1 | 7/2003 | Koo et al. | |
| 2004/0177772 | A1 * | 9/2004 | Ohno | 99/519 |
| 2007/0193455 | A1 * | 8/2007 | Koreda et al. | 99/600 |

FOREIGN PATENT DOCUMENTS

| | | |
|---|---|---|
| JP | 29-016427 | 12/1929 |
| JP | 52-107961 | 9/1977 |
| JP | 62-140653 | 6/1987 |
| JP | 08-131789 | 5/1996 |
| JP | 10-015408 | 1/1998 |
| JP | 11-090248 | 4/1999 |
| JP | 2003-200026 | 7/2003 |
| JP | 2005-138101 | 6/2005 |

OTHER PUBLICATIONS

Bench-scale testing of surfactant-modified reverse osmosis/nanofiltration membranes, by M.C. Wilbert et al, Desalination, Elsevier, Amsterdam, NL, vol. 115, No. 1, Mar. 1998, pp. 15-32.

* cited by examiner

APPARATUS AND PROCESS FOR PRODUCING SURFACE-TREATED GRANULAR PRODUCT AND SURFACE-TREATED GRANULAR PRODUCT

TECHNICAL FIELD

The present invention relates to an apparatus and a process for producing a surface-treated granular product by surface-treating a granular material comprising a granular raw food material, for example, a granular cereal, such as wheat, rice or buckwheat, or a bean harvest or other granular material, by abrading or cutting off of a superficial layer, as well as to the so-obtained surface-treated granular product. More specifically, the present invention relates to an apparatus and a process for producing a surface-treated granular product by surface-treating a granular material by abrading or cutting-off of a superficial layer by means of a flexible abrading tool, and to the so-obtained surface-treated granular product as well as to processed goods comprising it.

TECHNOLOGICAL BACKGROUND

For preparing a processed cereal product, such as polished rice, polished wheat or polished buckwheat, there have practically been used a grinding machine, rice-polishing machine, de-coating machine and the like for removing a superficial layer including seed-coat or pericarp from raw grain, such as brown rice, raw wheat or raw buckwheat. The fundamental mechanism therefor resides in a dynamic action by the impingement or abrasion of cereal grains against each other or impact upon the hitting of grains by a mixer blade or beater onto a hard surface, such as a hard rubber plate, in order to remove a surface layer of such grains. However, such conventional techniques by means of impact cannot realize the removal of a surface coat layer at fine concavities including secluded or recessed portions or thin wrinkles, such as seed surface grooves of wheat, seed surface canals of barley and so on, though valuable portions, such as germs and other parts, may be cut off. While there has been practiced a rice polishing technique in which unpolished rice grains are pressedly guided by, for example, a screw or the like, through a guide path inside an outer cylinder provided with punched elements so as to realize the removal of a grain superficial layer by abrasion due to the frictional action between grains with each other and between the inside structure of the outer cylinder and the grains, this technique suffers from a disadvantage of being subject to heat evolution which may result in the denaturation of taste and decomposition of useful components.

Hulls or husks of grains, such as rice or the like, can be removed by passing the grain through a gap between rubber rolls in a husker, however, pericarps of buckwheat (buckwheat husks) can only difficultly be removed by a husker. For removing or abrading a superficial layer of grain of wheat or the like, there has been practiced a method in which the grain is passed through a gap between confronting abrading rolls. Also by this method, however, it is difficult to abrade off a grain surface layer within a recessed site, such as a seed groove of wheat or surface canal of barley. As explained above, it has been difficult to attain processing of a granular material, such as cereal grains, by conventional surface-treating methods without suffering from denaturation due to the debasement of the intrinsic properties of useful components by deactivation caused by heating and oxidation due to the heat evolution during processing operations, while attaining the removal of useless parts, such as useless superficial layers, surface grooves and so on.

In Patent Document 1 (JPA 10-15408), a rice polishing machine is disclosed, in which a rotary element provided on its outer circumferential face with brush means is rotated in a cylinder within a layer of rice stored in the cylinder to polish the rice. Here, the brush means functions only to move local rice grains around the brush means aside within the stored rice layer upon the rotation to effect mutual friction between the rice grains, so that the essential action of the brush means does not differ from that of conventional rotary blades or beaters and the attainment of the removal of a grain superficial layer at narrow secluded or recessed portions, such as grain seed grooves of wheat or seed surface canals of barley, is not possible.

Patent Document 1: JPA 10-15408

DISCLOSURE OF THE INVENTION

Object of the Invention

The object of the present invention is to provide an apparatus and a process for producing a surface-treated granular product, as well as a surface-treated granular product obtained therefrom, and processed goods comprising it, wherein a finely processed surface-treated granular substance or product of better quality can be obtained through a simple means and simple operation, while attaining removal of useless parts, such as an inedible superficial layer, oxidized surface layer and attached foreign substances, without causing denaturation, decomposition or removal of useful contents, by effecting the efficient abrading off of a superficial layer without applying excessive pressure and superfluous temperature, even in the case of cereals having germs and seed coats, such as hulled (unpolished) rice and hulled buckwheat and, in the case of granular raw materials having fine concavities including narrow surface grooves or recessed canals, such as wheat and barley.

Means for Solving the Object

The present invention consists of an apparatus and a process for producing a surface-treated granular product, a surface-treated granular product obtained thereby and processed goods containing such a product, as given below:

(1) An apparatus for producing a surface-treated granular product comprising a cylindrical retainer having a multiplicity of retaining sites for retaining each granule of granular material travelling along the inside face of the retainer, an abrading tool having a number of elongate flexible abrading segments which are disposed extending radially of the rotary shaft that extends along the central axis of the cylindrical retainer so as to permit the rotation thereof and are each arranged in such a way that the terminal tip thereof touches the surface of each granule of the granular material retained at the retaining site of the retainer while rotating, a raw material supply site for supplying granular raw material to the cylindrical retainer and a treated product discharge site for discharging surface-treated granular product from the cylindrical retainer.

(2) The apparatus as defined in the above (1), wherein the cylindrical retainer is constituted of a punched material having a number of small apertures as the retaining sites.

(3) The apparatus as defined in the above (1) or (2), wherein it comprises one or more adjusting means for adjusting the diameter of the cylindrical retainer.

(4) The apparatus as defined in any one of the above (1) to (3), wherein the elongate abrading segments are made of a plastic resin having compounded therein whet particles.

(5) The apparatus as defined in any one of the above (1) to (4), wherein the abrading tool is constructed so that a number of abrader disks, each of which has the elongate abrading segments extending radially, made of the plastic resin having compounded therein whet particles are piled up along the rotary shaft.

(6) The apparatus as defined in the above (5), wherein the abrading tool is constructed so that a number of abrader disks, each of which has the elongate abrading segments extending radially, made of the plastic resin having compounded therein whet particles, are piled up under intermediation between each of them by a polishing disk and/or a spacer, wherein the peripheral edge of the disk and/or the spacer is recessed from the terminal tips of the elongate abrading segments.

(7) The apparatus as defined in any one of the above (1) to (6), wherein it comprises a discriminator for discriminating the treatment state of the surface-treated granular product discharged from the treated product discharge site and a sorting means for sorting the so-discriminated surface-treated granular product.

(8) A process for producing a surface-treated granular product, characterized in that it comprises characteristic features comprising supplying raw granular material to a cylindrical retainer having a multiplicity of retaining sites for retaining each granule of granular material travelling along the inside face of the retainer, rotating an abrading tool having a number of elongate flexible abrading segments which extend radially of a rotary shaft extending along the central axis of the cylindrical retainer, in a condition in which each granule of the raw granular material is retained at the retaining site, to thereby cause the terminal tip of the elongate abrading segment to touch the surface of the granule of the granular material while rotating, in order to effect surface-treatment of the granular material.

(9) The process as defined in the above (8), wherein the apparatus as defined in any one of the above (1) to (6) is used.

(10) A surface-treated granular product obtained by the process as defined in the above (8) or (9).

(11) Processed goods comprising the surface-treated granular product as defined in the above (10).

In the present invention, as the raw granular material to be subjected to the surface-treatment, there may be recited granular food raw materials, such as cereals, for example, wheat, rice, buckwheat, and beans; and other granular materials, such as biological, organic and chemical particulate materials, without any restriction, so long as they can be subjected to such a surface treatment as abrasion, removal of superficial layers or the like. Among the cereal seeds, there may be recited, as adapted material to be subjected to the surface treatment, though not restricted only thereto, unhulled rice covered with chaff, buckwheat covered with pericarp; brown rice, wheat and barley covered with a seed coat and aleuron layer; maize covered with pericarp and a seed coat; soy bean having a seed coat and a cuticule layer; wheat and barley having seed surface grooves and seed surface canals; and other granular materials having hard and/or soft surface layers.

The surface treatment according to the present invention means a physical treatment of the surface of a granular material, for example, abrading or polishing of the surface, or cutting off of a superficial layer, by means of an abrading tool. There may be recited specifically, for example, the polishing of raw grains, such as wheat, barley, rice or buckwheat by removing a superficial layer including a seed coat of raw grains; fine processing of a granular material by removing useless parts on the surface thereof, such as inedible surface regions, oxidized film layers, attached foreign materials and so on; and abrasion of grains. Among them, there may be included a surface treatment for removing pericarps of buckwheat (buckwheat chaff) not attainable by a usually employed seed rubbing husker and there may also be included a processing for removing chaff of wheat and rice.

In the process for producing a surface-treated granular product according to the present invention, a surface-treated granular product is produced by supplying raw granular material to a cylindrical retainer having a multiplicity of retaining sites for retaining each granule of granular material travelling along the inside face of the retainer and rotating an abrading tool having a number of elongate flexible abrading segments which extend radially of a rotary shaft extending along the central axis of the cylindrical retainer in a condition in which each granule of the raw granular material is retained at the retaining site, to thereby cause the terminal tip of the elongate abrading segment to touch the surface of the granule of the granular material while rotating, in order to effect surface-treatment of the granular material.

The apparatus for producing a surface-treated granular product to be employed in the process for producing a surface-treated granular product according to the present invention comprises a cylindrical retainer having a multiplicity of retaining sites for retaining temporarily each granule of the granular material which travels along the inside face of the cylindrical retainer; an abrading tool having a number of elongate flexible abrader segments extending radially in such a way that the terminal tips thereof touch the surface of each granule of the granular material retained at the retaining site of the retainer upon rotation of the abrading segments; a raw material supply site for supplying the raw granular material to the cylindrical retainer; and a treated product discharge site for discharging the surface-treated granular product from the cylindrical retainer. According to the present invention, a surface-treated granular product is produced by using such an apparatus.

In the apparatus for producing a surface-treated granular product according to the present invention, the cylindrical retainer has a role of retaining each granule of the raw granular material for effecting the surface treatment of the retained granule, wherein the retainer is formed in a cylindrical configuration and is constructed so as to be provided with a multiplicity of retaining sites for retaining each granule of the granular material which travels along the inside face of the cylindrical retainer. For the retaining site, one which is provided with a number of small apertures adapted to retain temporarily each granule of the granular material is preferred due to its simple construction and simple method of manufacture, though a structure having protrusions adapted to retain each granule may also be applicable. For the cylindrical retainer, one which is made of a punched material having a number of small apertures as the retaining sites is preferred. Here, the small apertures may preferably be formed such that each aperture has an elliptical form and such elliptical apertures are aligned in a row in which each longitudinal axis of the ellipses of the apertures is in the direction along the outer circumference of a section of the retainer cylinder vertical to its axis so that the granules of the granular material are retained in the apertures with their longitudinal axes aligning in the direction of movement of the elongate flexible abrading segments. The cylindrical retainer may be disposed in a voluntary direction, such as horizontal, vertical or any other direction, wherein the direction of travelling of the granular material in a vertical arrangement may be either downwards or upwards. It is preferable that the cylindrical retainer is provided with one or more adjusting means for adjusting the diameter of the cylindrical retainer.

The elongate abrading segment is made of an elongate flexible material. A number of such elongate abrading segments are disposed extending radially around the rotary shaft which extends in the direction of the central axis of the retainer and are so arranged that the terminal tips of these abrading segments touch and press the surface of each granule of the granular material retained on the retaining site of the retainer upon rotation of the abrading segments. While the terminal tips of the abrading segments touch and press the surface of the granule retained on the retaining site, they may also touch and press the surface of granules sustained on the retainer inside face between granules retained on the neighboring retaining sites. A number of elongate abrading segments are arranged extending radially around the rotary shaft toward the internal circumference of the cylindrical retainer and they may be deformed upon rotation into some swirling form, since they are made of flexible material.

The elongate abrading segment is made of a flexible material exhibiting an abrasive property and may preferably be made of a plastic resin having compounded therein whet particles. As the whet particles, particles of ceramic grindstone or the like having particle sizes in the range of 0.0005-0.5 mm may be employed. As the plastic resin, those of various organic polymers, such as a polyester and so on, may be used. The elongate abrading segment may have any voluntary configuration permitting abrasive action, such as a wire, an elongate board with a tapering edge and so on. In using a plastic resin containing whet particles, it may be shaped by a usual plastic forming technique, which permits easy production. When the plurality of elongate abrading segments are formed as an abrader disk extending radially from a central portion, an increased strength and higher abrasion performance and so on are attained due to the integration of the whole body, together with the easy manufacture of the elongate abrading segments.

The abrading tool is constituted of a structured body on which a multiplicity of the above-mentioned elongate abrading segments are arranged extending radially around the rotary shaft that extends along the central axis of the cylindrical retainer. The elongate abrading segments are disposed all around the rotary shaft within a certain longitudinal range of the shaft and are arranged to extend out radially. Therefore, the abrading tool has an integral form of a cylinder in which interstices are formed between the elongate abrading segments. For the elongate abrading segments made of a plastic resin containing whet particles, it is preferable that the abrading tool is formed by piling up along the rotary shaft, under intermediation each by a spacer, a plurality of abrader disks each provided with many radially extending elongate abrading segments, whereby the strength and the abrasion performance and other characteristics are improved together with the simultaneous attainment of better manufacturability. Here, it is possible to build up the abrading tool by piling up a plurality of abrader disks, each having many surrounding elongate flexible abrading segments made of a plastic resin containing whet particles, along the rotary shaft under intermediation each by a polishing disk and/or a spacer of which the peripheral edge extends up to a range recessed from the terminal tips of the elongate flexible abrading segments.

The raw material supply site is constructed so as to permit the supply of the raw granular material to the cylindrical retainer and to guide the granular material into the interstices between the inside face of the cylindrical retainer and the terminal tips of the elongate abrading segments disposed on the abrading tool. The treated product discharge site is constructed so as to permit the granular product, which has been subjected to the surface treatment in between the retainer inside face and the terminal tips of the elongate abrading segments, to be discharged from the cylindrical retainer. As the means for supplying the raw granular material and as the means for discharging the surface-treated granular product, any pertinent mechanical means, such as a screw conveyer and the like, may be employed, while a means utilizing the action of a fluid, such as a pneumatic means or so on, may also be employed. When a means for discriminating and a means for sorting the treated granular product are installed at the treated granular product discharge site, it may be possible to discharge out or to turn back such a treated granular product which is specifically discriminated and sorted for its state of surface treatment.

In the above-mentioned apparatus for producing surface-treated granular product, a surface-treated granular product is produced by effecting surface treatment of the granular material in such a manner, that a raw granular material is supplied via the raw material supply site to the cylindrical retainer and the abrading tool provided with a number of elongate flexible abrading segments extending radially is rotated, in a state in which each granule of the raw granular material is retained at each retaining site of the cylindrical retainer, while the granules of the raw granular material are caused to travel between the inside face of the cylindrical retainer and the elongate abrading segments disposed on the abrading tool, to thereby cause the terminal tips of the elongate flexible abrading segments to touch the surface of each granule retained at the retaining site while rotating.

Here, the granules of the raw granular material are caused to travel in the interstices between the cylindrical retainer inside face and the elongate flexible abrading segments disposed on the abrading tool, during which each granule is caused to be retained temporarily at each retaining site. By rotating the abrading tool in this state, terminal tips of the elongate flexible abrading segments touch the surface of each granule while rotating to abrade off the superficial layer of the granule efficiently without imparting thereto any excessive pressure or superfluous temperature to attain removal of any inedible substance attached to the granule, oxidized surface layer and other useless ingredients without causing any deterioration, decomposition and deprivation of valuable components, whereby a well refined surface-treated granular product of better quality is produced.

The granule retained at the retaining site will then be caused to travel to the next retaining site while rolling by rotation of the elongate abrading segments and is subjected here to a surface treatment operation similar to that at the foregoing retaining site and such a surface treatment operation is repeated successively. In this manner, it is possible to abrade off useless parts even in a narrow recessed site, such as seed surface grooves and surface canals found at grain tips, even for a raw granular material exhibiting on its surface fine concavities including narrow indentations, such as seed surface grooves or surface canals, such as wheat or barley. In particular, when the cylindrical retainer has many elliptical apertures aligned with their longitudinal axes being held in the same direction as the direction of movement of the terminal tips of the elongate abrading segments disposed on the abrading tool so that the granules of the granular material are retained in the retaining sites in the same orientation, the performance of surface treatment is increased and abrasion at narrow recessed portions, such as seed surface grooves and surface canals, can be realized efficiently, since such seed surface grooves and surface canals of the granules of raw granular material align in the same direction as that of the movement of terminal tips of the elongate abrading segments.

If the cylindrical retainer is constituted of a punched material having many apertures, retention of the raw granular material is assured and, at the same time, manufacture is made easy and formation, design, orientation, arrangement and so on of apertures become easy. If the cylindrical retainer is provided with one or more adjusting means for adjusting the diameter of the retainer, it is possible to adjust the performance of surface treatment by adjusting the distance of the interstices between the inside face of the retainer and the terminal tips of the elongate abrading segments, to thereby adjust the force of pressing of the terminal tips of the elongate abrading segments onto the surface of the granule of the granular material retained at the retaining site.

If the elongate abrading segment is made of a plastic resin containing whet particles, a higher performance of surface-treatment, such as abrasion and the like, is attainable, so that the outer husks of cereals including pericarp of buckwheat and the like, and other firmly attached matters can easily be abraded off and facilitated manufacturability is also favorable. When the plurality of elongate abrading segments are formed as an abrader disk extending radially from a central portion, increased strength and higher abrasion performance and so on are attained due to the integration of the whole body, together with the easy manufacture of the elongate abrading segments and easy formation of the abrading tool as well. Thus, the abrading tool can be manufactured easily by simply piling the abrader disks, in which the elongate abrading segments made of the plastic resin having compounded therein whet particles are bodily formed, one over another along the rotary shaft, whereby an assembled abrading tool exhibiting a higher strength and abrading performance is obtained due to integration of the whole body. Here, it is possible to assemble the abrading tool by piling abrader disks, each having elongate abrading segments made of a plastic resin containing whet particles extending radially from a central part of the disk under intermediation between each disk by a spacer, wherein it is preferable that the peripheral edge of the spacer is recessed from the terminal tips of the elongate abrading segments which extend radially around each abrader disk. When the abrader disks are piled under intermediation by a circular polishing disk, such as diamond disk, of which peripheral edge is recessed from the terminal tips of the elongate abrading segment, a more increased abrasion performance can be attained and removal of the outer husk or the like becomes more easy.

The surface-treated granular product according to the present invention is a product which is produced in the manner as above. The processed goods according to the present invention are those containing the surface-treated granular product which is produced in the manner as given above.

Inventive Effect

As described above, surface treatment of the granular material is performed according to the present invention by a process which comprises supplying raw granular material to a cylindrical retainer having a multiplicity of retaining sites for retaining each granule of a granular material which travels along the inside face of the retainer, rotating an abrading tool having a number of elongate flexible abrading segments, which extend radially of a rotary shaft extending along the central axis of the cylindrical retainer, in a condition in which each granule of the raw granular material is retained in the retaining site to thereby cause the terminal tip of the elongate abrading segment to touch the surface of the granule of the granular material while rotating, in order to effect surface-treatment of the granular material. Therefore, even such raw granular materials, such as cereal grains including germs and husks, such as unhusked rice, unhusked buckwheat and the like, and grains including seed surface grooves and surface canals, such as wheat and barley, can efficiently be abraded to remove useless parts including superficial inedible parts, oxidized layers and attached foreign matters, without imparting to the surface of the granules of the granular material excessive pressure or superfluous temperature, to thereby produce a finely refined surface-treated granular product and processed goods of better quality.

EXPLANATION OF THE SYMBOLS

Figure 1:
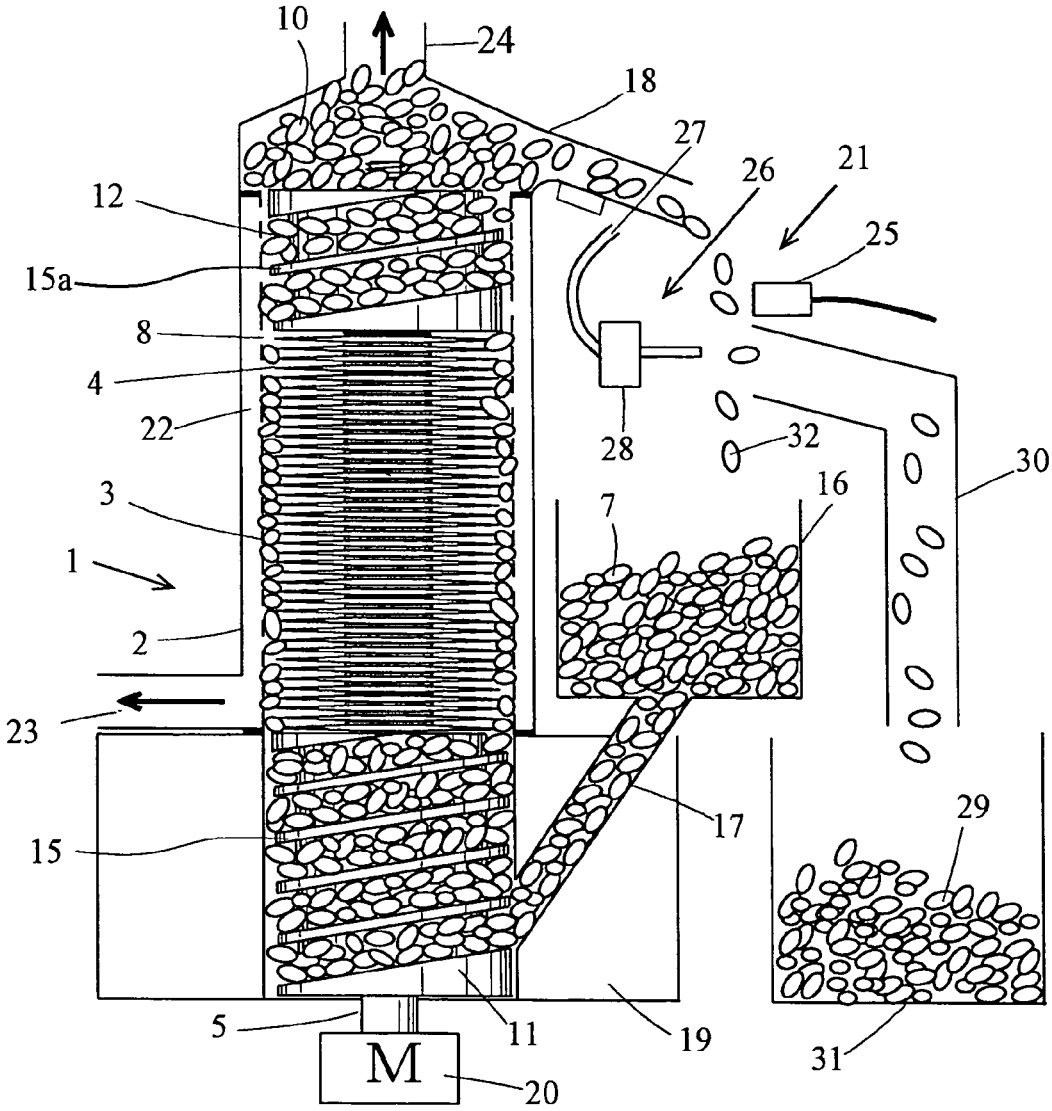
FIG. 1: A vertical sectional view of the apparatus for producing surface-treated granular product of one mode of an embodiment.

The symbols indicate:

1: Abrading section
2: Outer cylinder
3: Cylindrical retainer
4: Abrading tool
5: Rotary shaft
6: Elongate abrading segment
7: Granular material
7*a*: Albumen
7*b*: Germ
8: Retaining site
9: Abrader disk
10: Surface-treated granular product
11: Raw material supply site
12: Treated product discharge site
13: Interstice
14: Spacer
15, 15*a*: Screw conveyer
16: Raw material hopper
17: Guide path
18: Treated granular product discharge path
19: Supporting basement
20: Driving unit
21: Sorting section
22: Refuse guide space
23: Refuse discharge path
24: Aspirated exit
25: Discriminator
26: Sorting means
27: Compressed air supply line

28: Electromotive valve for air blow
29: Sorted granular product
30: Sorted granular product guide path
31: Sorted granular product receiver
32: Off-sorted granular product
33: Polishing disk
34: Adjusting means
35: Pressing means

THE BEST MODE FOR EMBODYING THE INVENTION

Below, the present invention is described in more detail by way of mode of embodiment with reference to the appended Drawings.

Figure 2:
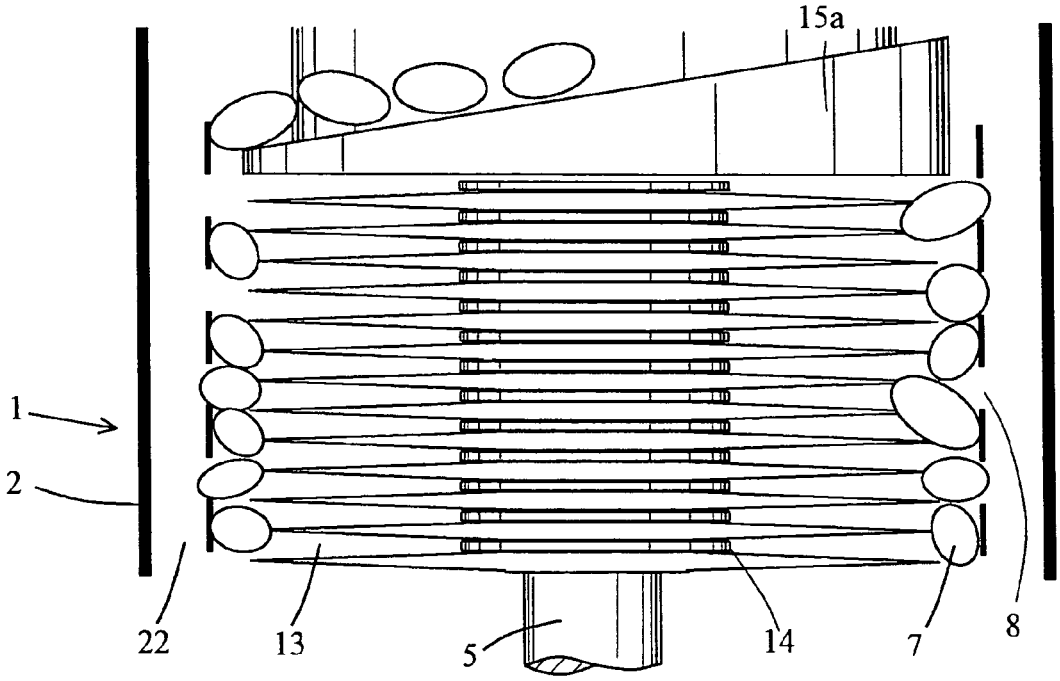
FIG. 2: An enlarged sectional view of a part of FIG. 1.
Figure 3:
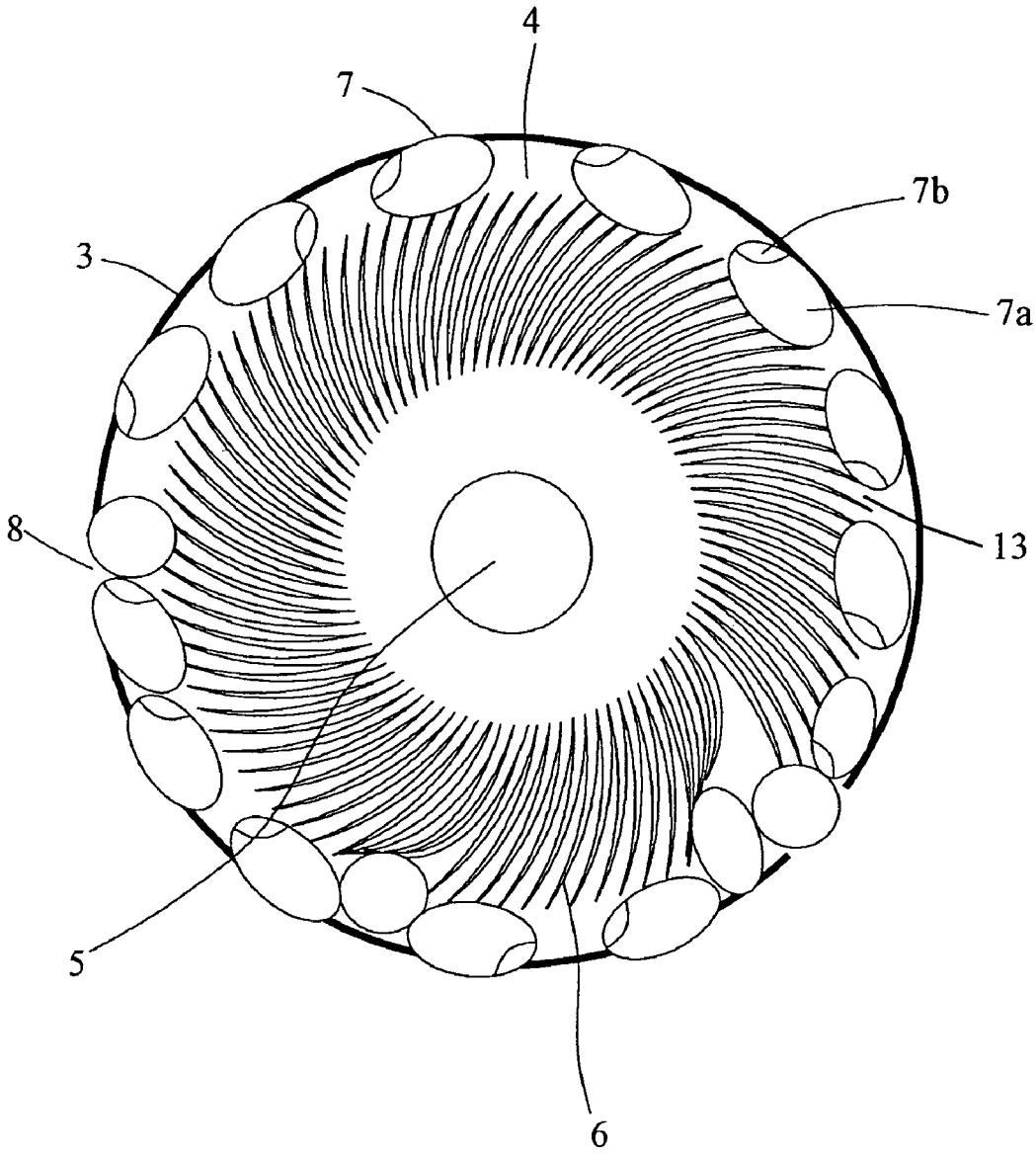
FIG. 3: A horizontal sectional view of the part shown in FIG. 2.
Figure 4:
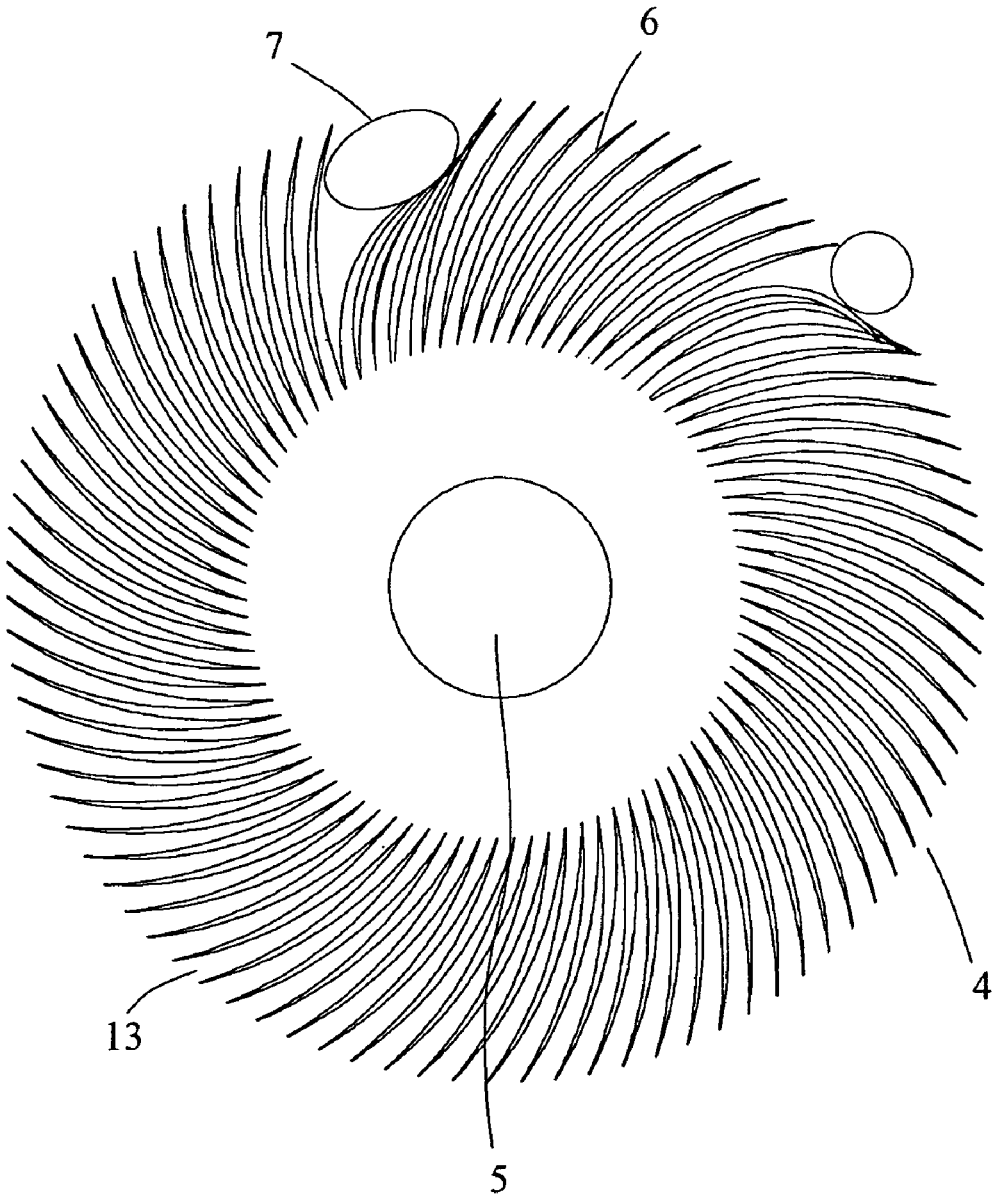
FIG. 4: A horizontal sectional view of the abrading tool.
Figure 5:
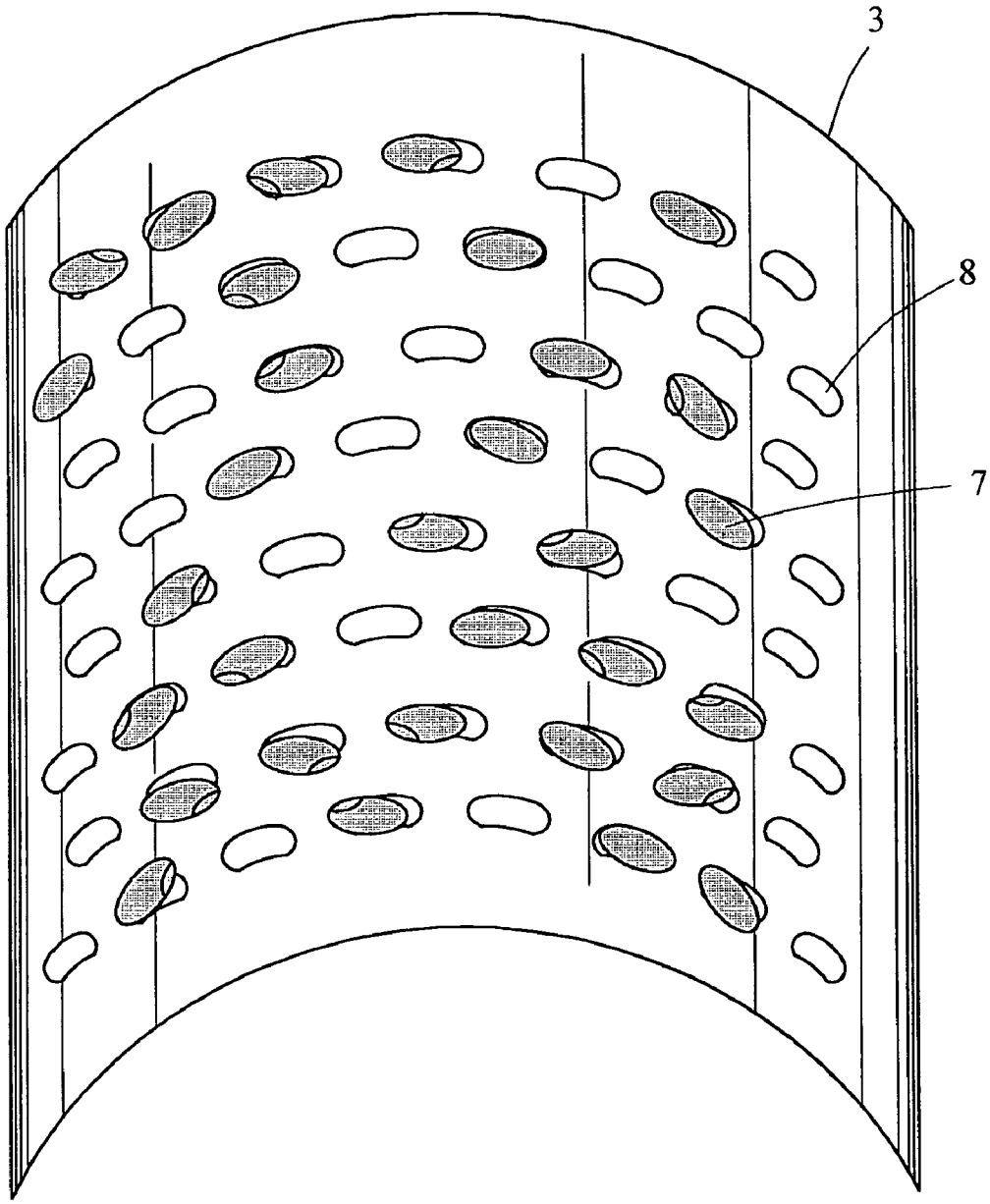
FIG. 5: A perspective view of a part of the cylindrical retainer.

FIG. 1 depicts an apparatus for producing a surface-treated granular product of one mode of embodiment in a vertical sectional view, FIG. 2 is an enlarged sectional view of a part thereof, FIG. 3 is a horizontal sectional view thereof, FIG. 4 is a plan view of one embodiment of the abrading tool and FIG. 5 is a perspective view of a part of the cylindrical retainer.

In the Drawings of FIGS. 1-5, the apparatus for producing the surface-treated granular product is shown, wherein, in an abrading section 1, a cylindrical retainer 3 is housed in a vertical posture within an upright outer cylinder 2, within which an abrading tool 4 is disposed. A number of elongate flexible abrading segments 6 extend out radially in a swirling form towards the inside face of the retainer 3 over the abrading tool 4 surrounding a rotary shaft 5 which serves for rotation of the abrading tool 4. The cylindrical retainer 3 is made of a punched material which is formed into a cylinder and is provided with a number of retaining sites 8, each constituted by a small aperture, in which each granule of the granular material 7 that travels along the inside face of the cylindrical retainer 3 is temporarily retained. The elongate abrading segments 6 are formed around the abrading tool 4 encircling the rotary shaft 5 so as to extend radially outwardly therefrom in such a manner that the terminal tips of the elongate abrading segments 6 touch the surface of each granule 7 of the granular material retained in each retaining site 8 of the cylindrical retainer 3 upon rotation of the abrading tool 4. A raw material supply site 11 is disposed at a lower portion of the cylindrical retainer 3 for supplying the raw granular material 7 to the cylindrical retainer 3. A treated product discharge site 12 is disposed in the upper part of the cylindrical retainer 3 for discharging the surface-treated granular product 10.

The cylindrical retainer 3 has a role for retaining each granule 7 of the raw granular material for effecting the surface treatment of the retained granule and is formed in a cylindrical form, as mentioned above, and provided with a multiplicity of retaining sites 8 for retaining each granule 7 travelling along the inside face of the cylindrical retainer 3. For the retaining sites 8, a multiplicity of small apertures are disposed for retaining temporarily therein each granule 7, wherein it is permissible that protrusions adapted for restraining the granule are provided, while preference is given to small apertures for their simple structure and easy manufacturability. Due to the use of a punched material provided with a multiplicity of small apertures as the retaining sites 8 for the cylindrical retainer 3, a simple and convenient structure and manufacturability can be realized. Here, it is preferable that the small apertures serving as the retaining sites 8 are each formed in an elliptical configuration and are arranged so as to retain the granules 7 in alignment with their longitudinal axes being directed to the direction of movement of the terminal tips of the elongate abrading segments 6, namely, in the circumferential direction of the cylindrical retainer 3. The cylindrical retainer 3 is disposed in vertical posture.

The elongate abrading segment 6 is made of an elongate flexible material. A number of such elongate abrading segments 6 are disposed extending radially around the rotary shaft 5 which extends in the direction of the central axis of the retainer 3 and are so arranged that the terminal tips of these abrading segments 6 touch and press the surface of each granule 7 of the granular material retained on the retaining site 8 of the cylindrical retainer 3 upon rotation of the abrading segments. While the terminal tips of the elongate abrading segments 6 are disposed to touch and press the surface of the granule 7 retained on the retaining site 8 of the cylindrical retainer 3, they may also touch and press the surfaces of other granules 7 sustained on the retainer inside face between granules 7 retained on the retaining site 8. A number of such elongate abrading segments 6 made of a flexible material are arranged extending radially around the rotary shaft 5 toward the inner circumference of the cylindrical retainer 3 and they may be deformed upon rotation into some swirling form so as to build up some eddy form as a whole.

The elongate abrading segments 6 are made of a flexible abrading material, such as a plastic resin having compounded therein whet particles. As the particles of whet, those of, for example, ceramic grindstone, having particle sizes in the range of 0.0005-0.5 mm may be employed. As the plastic resin, those of organic polymers, such as polyester and the like, may be used. The elongate abrading segment 6 may be in a form of an elongate board or strip with a tapered peripheral edge, although other forms allowing abrasion may be permitted, such as a wire and so on. The elongate abrading segments 6, which are made of a flexible plastic resin having compounded therein whet particles, can easily be obtained by a conventional plastic molding technique. Since the elongate abrading segments 6 are formed bodily to form an abrader disk 9 in which the abrading segments 6 are disposed surrounding the central part thereof so as to extend radially therefrom, it is possible to attain higher strength and better abrasion performance together with easy manufacture.

The abrading tool 4 is constituted of a structured body on which a multiplicity of the above-mentioned elongate abrading segments 6 are arranged extending radially around the rotary shaft 5 that extends along the central axis of the cylindrical retainer 3. The elongate abrading segments 6 are disposed all around the rotary shaft 5 within a certain longitudinal range of the shaft 5 and are arranged to extend out radially. Therefore, the abrading tool 4 has an integral form of cylinder in which interstices 13 are formed between the elongate abrading segments 6. The abrading tool 4, constructed by piling up, along the rotary shaft 5, the abrader disks 9 having a number of elongate abrading segments 6 made of a plastic resin containing whet particles extending radially around the rotary shaft 5, is integrally formed and its strength, abrasion performance and other characteristics are improved together with the simultaneous attainment of easy manufacturability. Here, the abrading tool 4 is formed by piling up along the rotary shaft 5, each under intermediation by a spacer 14, a plurality of abrader disks 9, each being provided with many radially extending elongate flexible abrading segments 6 made of a plastic resin containing whet particles.

The raw granular material supply site 11 is constituted of a screw conveyer 15 connected to the lower part of the cylindrical retainer 3 so as to permit the supplying of the raw granular material 7 to the cylindrical retainer 3 and to guide the granular material 7 into the interstices between the inside face of the cylindrical retainer 3 and the terminal tips of the elongate abrading segments 6 of the abrading tool 4. The screw conveyer 15 is connected to a guide path 17 serving to guide the raw granular material 7 from a raw material hopper 16 to the conveyer 15. Surrounding the raw material supply site 11, there is constructed a supporting basement 19.

The treated product discharge site 12 is constructed so as to permit the surface-treated granular product 10, which has been subjected to the surface treatment in between the retainer 3 and the terminal tips of the elongate abrading segments 6, to be discharged from the cylindrical retainer 3, by a screw conveyer 15*a* connected to the upper part of the cylindrical retainer 3 which opens into a treated granular product discharge path 18 connected to a sorting section 21. Between the outer cylinder 2 and the cylindrical retainer 3, a refuse guide space 22 for guiding out the refuse from abrading of the granular material is provided, which communicates to a refuse discharge path 23. Above the treated product discharge site 12, an aspirated exit 24 is disposed. The abrading tool 4 and the screw conveyers 15 and 15*a* are rotatable by the rotary shaft 5 by actuation of a driving unit 20.

In the sorting section 21, there is disposed, as a discriminator 25, a color sensor in opposition to the treated granular product discharge path 18 for discriminating each of the surface-treated granular products 10 discharged out from the treated product discharge site 12 and also is disposed, as a sorting means 26, an electromagnetic valve 28 for air-blow, which is connected a compressed air supply line 27. The treated granular product discharge path 18 of the treated product discharge site 12 opens into an upper portion of the raw material hopper 16. A sorted granular product guide path 30 is arranged in opposition to the compressed air discharge outlet connected with the compressed air supply line 27, for collecting the sorted granular product 29 which is guided into a sorted granular product receiver 31.

In the apparatus for producing the above-mentioned surface-treated granular product 10, the raw granular material 7 is supplied to the raw material supply site 11 from the raw material hopper 16 via the guide path 17 and is then guided from the raw material supply site 11 to the cylindrical retainer 3 by operating the screw conveyer 15 by actuating the driving unit 20. In the cylindrical retainer 3, the granules 7 are caused to travel between the inside face of the cylindrical retainer 3 and the terminal tips of the elongate abrading segments 6 to any vacant granular material retaining site 8, in which the granules 7 are retained. By rotating the rotary shaft 5, the abrading tool 4 is rotated and the terminal tips of the elongate abrading segments 6 which touch the surface of each granule 7 retained in the retaining site 8 are rotated to effect surface-treatment of each granule 7 of the granular material, whereby surface-treated granular product 10 is produced.

The raw granular material 7 has albumen 7*a* and germ 7*b*. Each granule 7 of the raw granular material travels within the interstice between the inside face of the cylindrical retainer 3 and the terminal tips of the elongate abrading segments 6 and is captured meanwhile in each retaining site 8 on the retainer 3 and is retained there temporarily. When the abrading tool 4 is rotated in this state, the terminal tips of the elongate abrading segments 6 touch and scrape the surface of each granule 7 retained in the retaining site 8 and efficient abrasion of the superficial layer of the granule 7 is realized without imparting any excessive pressure and any superfluous temperature to the granule surface, whereby useless ingredients, such as inedible parts, oxidized layers and other matters attached thereto, can be removed. In this way, a finely refined surface-treated granular product 10 of better quality is produced without suffering from denaturation, decomposition or deprivation of valuable components.

The granules 7 retained in the retaining site 8 will then be caused to travel by rolling on the retainer inside face by rotation of the elongate abrading segments 6 to the next retaining site 8 and are subjected here to a surface treatment operation similar to that in the foregoing retaining site and such a surface treatment operation is repeated successively. In this manner, it is possible to abrade off useless parts even in a narrow recessed site, such as seed surface grooves and surface canals found at grain tips, even for a raw granular material 7 exhibiting on its surface a narrow indentation such as seed surface grooves or surface canals, such as wheat or barley. Since the retaining sites 8 are of many elliptical small apertures disposed in alignment with their longitudinal axes oriented to the circumferential direction of the cylindrical retainer 3, the granules 7 are held in the direction same as the direction of movement of the terminal tips of the elongate abrading segments 6 so that the granules 7 of the granular material are retained in the retaining sites 8 in the same orientation. Therefore, abrasion at narrow recessed portions, such as seed surface groove and surface canal, can be realized sufficiently, since such seed surface groove and surface canal of the granules 7 of raw granular material align in the direction same as that of the movement of terminal tips of the elongate abrading segments 6.

During the above operation, the raw granular material 7 is conveyed by the screw conveyer 15 while the abrading tool 4 is rotated and the raw granular material 7 is moved upwards in between the inside face of the cylindrical retainer 3 and the terminal tips of the elongate abrading segments 6 of the abrading tool 4 while being subjected to surface treatment, such as abrasion and the like, before it is guided out into the treated product discharge site 12. The refuse from the surface treatment, such as the removed seed coat fragments and the like, which has passed through the apertures of the retaining sites 8 of the cylindrical retainer 3, falls within a refuse guide space 22 and is guided out through a refuse discharge path 23. The surface-treated granular product 10 transferred to the treated product discharge site 12 is guided out through the screw conveyer 15*a* to a sorting section 21 via the treated granular product discharge path 18, while being separated from floating fragments, which are guided out by aspiration through an aspirated exit 24.

In the sorting section 21, each granule of the surface-treated granular product 10 guided out through the treated product discharge site 12 is subjected to discrimination for its color using a color sensor as a discriminator 25 whether the surface treatment was complete or not. When the granule was discriminated that the treatment was complete, a sorting means 26 constituted of an electromagnetic valve 28 for air blowing is actuated to cause compressed air from a compressed air supply line 27 to be jetted out, whereby the sorted granuler product 29 is guided to a sorted granular product receiver 31 through a sorted granular product guide path 30. When the granule was discriminated that the treatment was incomplete, the electromagnetic valve 28 in the sorting means 26 is put off, whereby the off-sorted granular product 32 is guided back to the raw material hopper 16, in order to be subjected to the surface treatment again.

Since the cylindrical retainer 3 is made of a punched material having many small apertures as the retaining sites 8, an assured retention of the granule 7 of the raw granular material is attained and manufacture of the cylindrical retainer 3 is made easy, together with easiness in design, selection of configuration and orientation, arrangement and formation of apertures. Since the elongate abrading segment 6 is made of a plastic resin compounded with whet particles, a higher performance of surface-treatment, such as abrasion and the like, is attainable, so that outer husks of cereals, such as pericarp of buckwheat and the like, and other firmly attached matters can easily be abraded off and facilitated manufacturability is also attained. Since the abrader disk 9 is provided with a number of elongate flexible abrading segments 6 extending radially from the central part, increased strength and higher abrading performance can be attained due to integration of the whole body, together with facilitation of the manufacture of the abrading tool 4. Thus, it can be manufactured easily by simply piling the abrader disks 9 having bodily the elongate abrading segments 6 one over another along the rotary shaft 5, whereby a bodily assembled abrading tool 4 exhibiting a higher strength and abrading performance is obtained.

Figure 6:
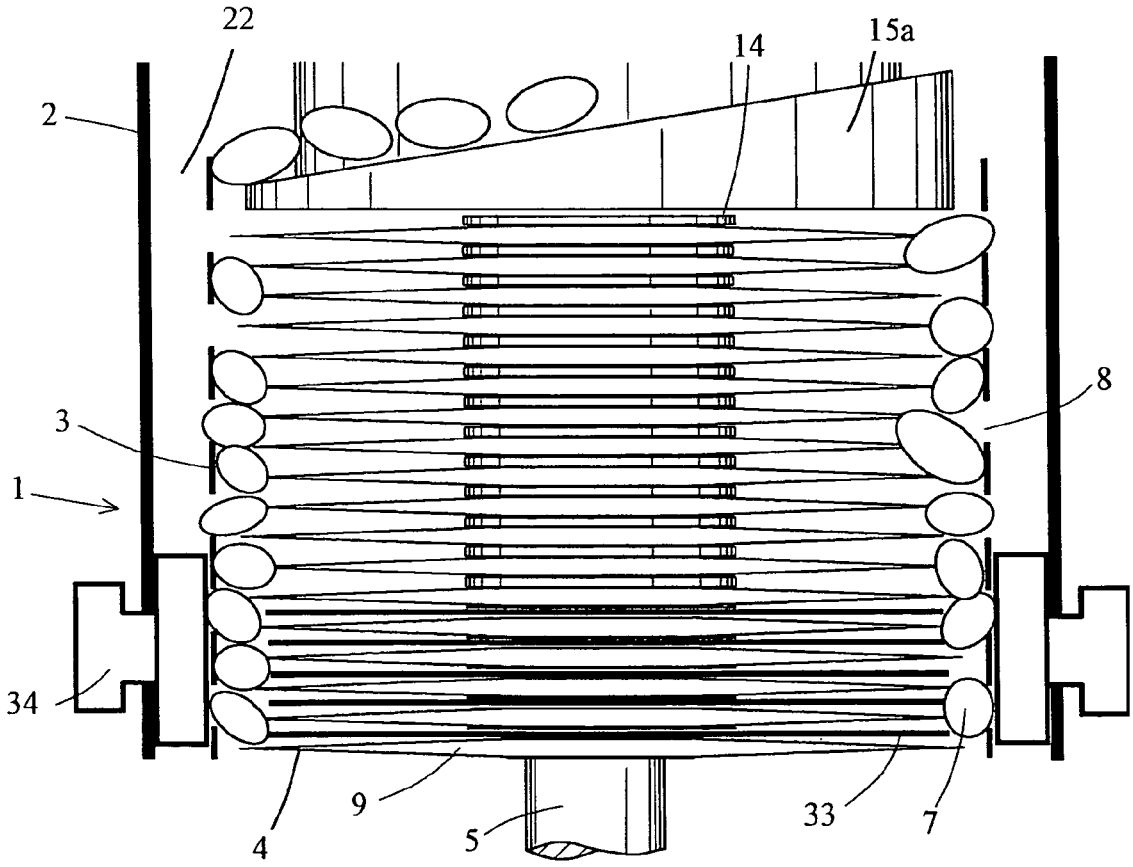
FIG. 6: An enlarged sectional view of the apparatus for producing surface-treated granular product of another mode of an embodiment.

FIG. 6 is an enlarged sectional view of the apparatus for producing surface-treated granular product in another mode of an embodiment shown in a section corresponding to FIG. 2. In this mode of embodiment, the abrading tool 4 is constituted of an assembly of a construction in which a number of abrader disks 9, each having bodily formed elongate abrading segments 6, are piled up along the rotary shaft 5 under intermediation between each abrader disk with a spacer 14, in one region of the assembly and, in the other region, a number of abrader disks 9, each having bodily formed elongate abrading segments 6, are piled up along the rotary shaft 5 under intermediation between each abrader disk with a polishing disk 33, instead of the spacer 14, wherein the polishing disk 33 is so designed that the peripheral edge thereof is recessed, when assembled, from the terminal tips of the elongate abrading segments 6. Here, the polishing disk 33 may consist of a diamond disk. In this embodiment as shown in FIG. 6, adjusting means 34 is provided in the region of the assembly, in which the abrader disks 9 are piled under intermediation between each abrader disk 9 by a polishing disk 33, for adjusting the diameter of the cylindrical retainer 3 in order to adjust the distance of the interstices between the inside face of the cylindrical retainer 3 and the terminal tips of the elongate abrading segments 6 or of the abrader disks 9.

In the apparatus given above, the performance of abrasion of the surface of the granular material is higher, since the polishing disks 33, such as diamond disks, are arranged to be interposed between each abrader disks 9, whereby removal of, for example, outer husks and the like, becomes more easy. By the incorporation of the adjusting means 34 for adjusting the diameter of the cylindrical retainer 3 and, thus, the distance between the inside face of the cylindrical retainer 3 and the terminal tips of the elongate abrading segments 6, it is made possible to adjust the pressing force onto the surface of the granules 7 upon the touching of the terminal tips of the elongate abrading segments 6 thereonto, to thereby adjust the performance of the surface treatment.

Figure 7:
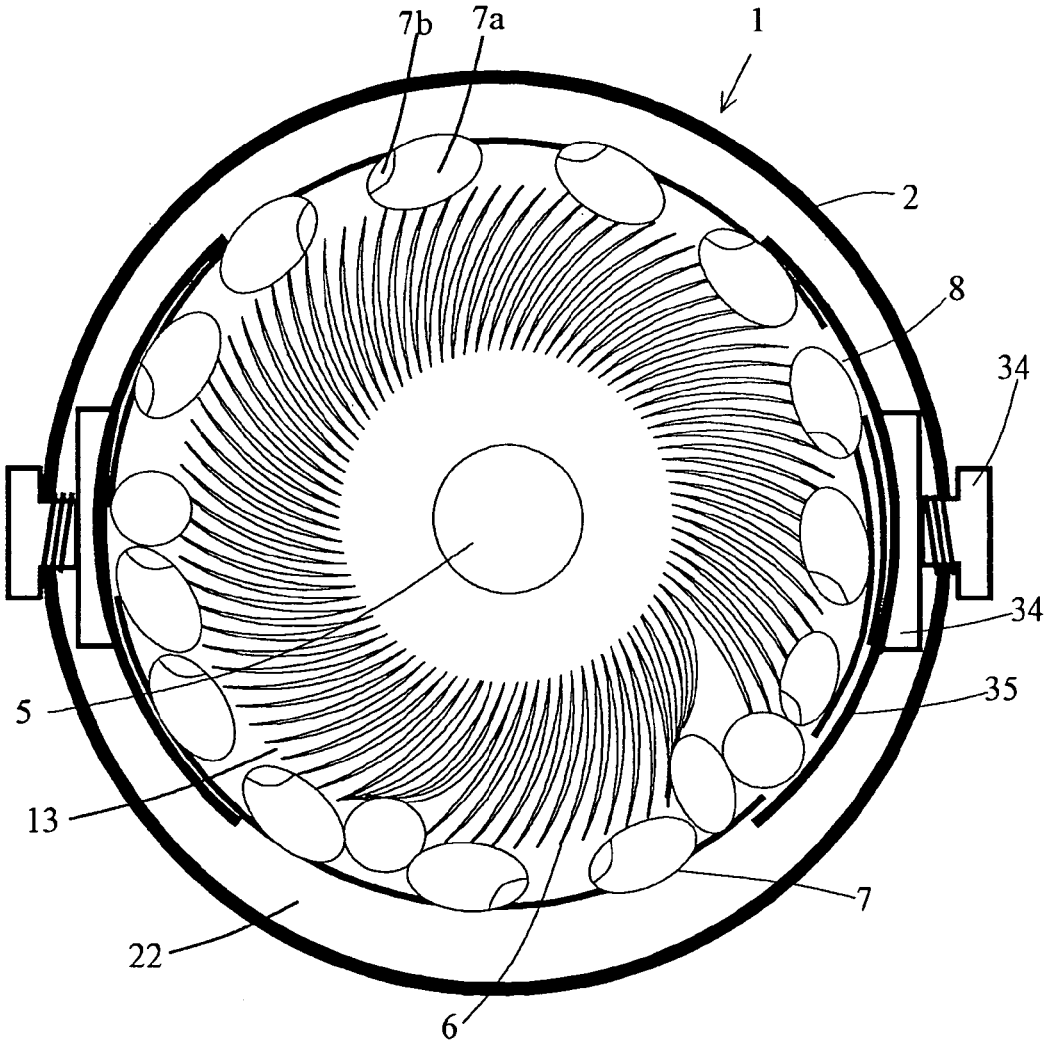
FIG. 7: A horizontal sectional view of the apparatus of a further mode of an embodiment.

FIG. 7 is a horizontal sectional view showing a further mode of an embodiment, shown corresponding to FIG. 3. In this embodiment, the cylindrical retainer 3 is made up from a rectangular plate by winding it into a cylinder in which the edges of the plate put together are held slidably to each other. Here, the so-formed cylinder of the retainer 3 is supported by pressing member 35 of an adjusting means 34 by compressing from outside. The diameter of the cylindrical retainer 3 can be adjusted by throttling the cylindrical retainer by the pressing member 35 of the adjusting means 34, so as to cause the plate ends put together to be slid, in order to adjust the distance of the interstices between the inside face of the retainer 3 and the terminal tips of the elongate abrading segments 6.

Figure 8:
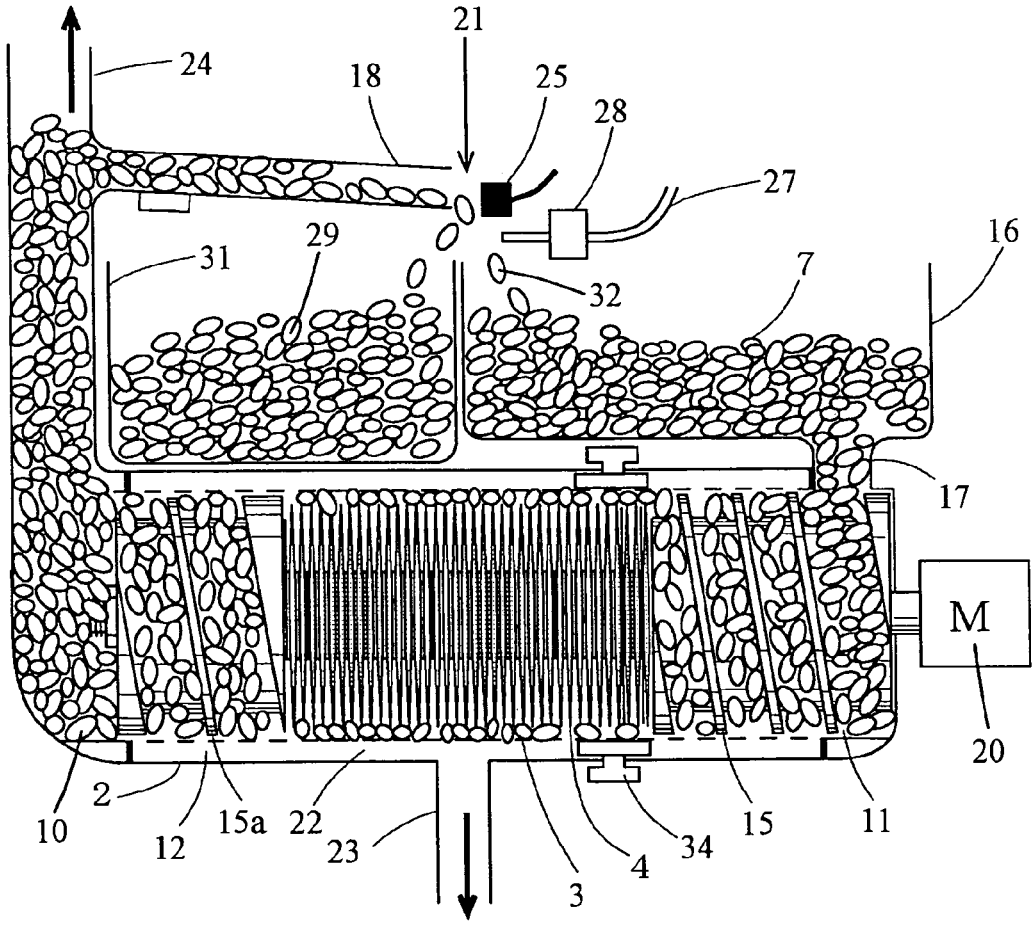
FIG. 8: A vertical sectional view of the apparatus of a still further mode of an embodiment.

FIG. 8 shows a vertical sectional view of a still further mode of an embodiment. In this embodiment, the abrading section 1, the raw material supply site 11 and the treated product discharge site 12 of the apparatus for producing the surface-treated granular product are disposed in a horizontal arrangement. Thus, in the abrading section 1, the cylindrical retainer 3 is disposed in a horizontally laid outer cylinder 2 in a horizontal posture, within which is arranged the abrading tool 4 provided with a number of elongate flexible abrading segments 6 extending radially in a somewhat swirled figure around the rotary shaft 5 of the cylindrical retainer 3 towards the inner face of the cylindrical retainer 3. The raw material hopper 16 is disposed above the raw material supply site 11 and the sorted granular product receiver 31 is positioned above the treated product discharge site 12. The sorting section 21 is located therebetween. In this embodiment, the raw granular material 7 travels in the apparatus in a horizontal direction and is subjected to surface treatment during such travel. The operation of the surface treatment of the granular material does not differ from that in the foregoing embodiment.

By the above-described embodiments, even a raw granular material 7 having germ and seed coats, such as raw cereal grain, for example, brown rice, husked raw grains of buckwheat and the like, and raw granular materials exhibiting fine concavities including narrow surface grooves and surface canals, such as wheat and barley and the like, can be subjected to facilitated surface treatment in which useless ingredients, such as inedible parts in the surface layer, oxidized film layers, attached foreign matters and so on are removed by abrading off the superficial layers of the granules efficiently without imparting thereto excessive pressure and superfluous temperature and without suffering from deterioration, decomposition or deprivation of valuable ingredients, by supplying the raw granular material 7 to the cylindrical retainer 3 having a multiplicity of retaining sites 8 for retaining each granule 7 of the granular material travelling along the inside face of the cylindrical retainer 3 and rotating an abrading tool 4 having a number of elongate flexible abrading segments 6 which extends radially of the rotary shaft 5 extending along the central axis of the cylindrical retainer 3, in a condition in which each granule 7 of the raw granular material is retained at the retaining site 8 of the cylindrical retainer 3, to thereby cause the terminal tips of the elongate abrading segments 6 to touch the surface of the granule 7 of the granular material and to rotate, in order to effect surface-treatment of the granular material 7, so as to produce a refined surface-treated granular product of better quality.

INDUSTRIAL APPLICABILITY

The present invention is applied to a process and apparatus for producing surface-treated granular product and to the thereby obtained surface-treated product as well as to processed goods thereof, by subjecting a granular material, including a granular food raw material, such as cereal grains of wheat, rice and buckwheat and beans, as well as other granular material, to a surface treatment, such as abrasion or removal of a superficial layer.

The invention claimed is:

1. An apparatus for producing a surface-treated granular product comprising a cylindrical retainer having a plurality of retaining sites for retaining each granule of a granular material travelling along an inside face of the retainer, an abrading tool having a number of elongate flexible abrading segments which are disposed to extend radially of a rotary shaft that extends along the central axis of the cylindrical retainer so as to permit the rotation thereof and are each arranged in such a way that a terminal tip thereof touches the surface of each granule of the granular material retained at the retaining site of the retainer while rotating, a raw material supply site for supplying a granular raw material to the cylindrical retainer and a treated product discharge site for discharging a surface-treated granular product from the cylindrical retainer, wherein the retaining sites are provided with a number of small apertures adapted to sustain granules on the retainer inside face between granules to temporarily retain each granule of the granular material travelling along the inside face of the cylindrical retainer so that the terminal tips of the abrading segments touch and press the surface of the granule retained on the retaining site.

2. The apparatus as claimed in claim 1, wherein the cylindrical retainer is constituted of a punched material having a number of small apertures as the retaining sites.

3. The apparatus as claimed in claim 1, wherein it comprises one or more adjusting means for adjusting the diameter of the cylindrical retainer.

4. The apparatus as claimed in claim 1, wherein the elongate abrading segments are made of a plastic resin having whet particles compounded therein.

5. An apparatus for producing a surface-treated granular product comprising:

a cylindrical retainer having a plurality of retaining sites for retaining each granule of a granular material travelling along an inside face of the retainer;

an abrading tool having a number of elongate flexible abrading segments which are disposed to extend radially of a rotary shaft that extends along the central axis of the cylindrical retainer so as to permit the rotation thereof and are each arranged in such a way that the terminal tip thereof touches the surface of each granule of the granular material retained at the retaining site of the retainer while rotating;

a raw material supply site for supplying a granular raw material to the cylindrical retainer and a treated product discharge site for discharging surface-treated granular product from the cylindrical retainer, wherein the abrading tool is constructed so that a number of abrader disks, each of which has the elongate abrading segments extending radially made of a plastic resin having whet particles compounded therein, are piled up along the rotary shaft.

6. The apparatus as claimed in claim 5, wherein the abrading tool is constructed so that a number of abrader disks are piled up under intermediation between each of them by a polishing disk and/or a spacer, wherein the peripheral edge of the disk and/or the spacer is recessed from the terminal tips of the elongate abrading segments.

7. The apparatus as claimed in claim 5, wherein it comprises a discriminator for discriminating a treatment state of the surface-treated granular product discharged from the treated product discharge site and a sorting means for sorting the so-discriminated surface-treated granular product.

8. A process for producing a surface-treated granular product, characterized in that it comprises characteristic features comprising the steps of:

supplying a raw granular material to a cylindrical retainer having a plurality of retaining sites for retaining each granule of granular material travelling along an inside face of the retainer;

rotating an abrading tool having a number of elongate flexible abrading segments which extend radially of a rotary shaft extending along the central axis of the cylindrical retainer in a condition in which each granule of the raw granular material is retained at the retaining site and causing terminal tips of the elongate abrading segments to touch the surface of the granule of the granular material while rotating, in order to effect surface-treatment of the granular material, wherein the retaining site is provided with a number of small apertures adapted to sustain granules on the retainer inside face between granules to temporarily retain each granule of the granular material traveling along the inside face of the cylindrical retainer so that the terminal tips of the abrading segments touch and press the surface of the granules retained on the retaining sites.

9. A process for producing a surface-treated granular product, characterized in that it comprises characteristic features comprising the steps of:

supplying a raw granular material to a cylindrical retainer having a plurality of retaining sites for retaining each granule of a granular material traveling along an inside face of the retainer;

rotating an abrading tool having a number of elongate flexible abrading segments which extend radially of a rotary shaft extending along the central axis of the cylindrical retainer in a condition in which each granule of the raw granular material is retained at the retaining site and causing terminal tips of the elongate abrading segments to touch the surface of the granules of the granular material while rotating in order to effect surface-treatment of the granular material, wherein the apparatus as claimed in claim 1 is used.

* * * * *